United States Patent [19]

Hayashi et al.

[11] Patent Number: 4,803,316

[45] Date of Patent: Feb. 7, 1989

[54] PUSH BUTTON SWITCH USING DOME SPRING AND SWITCH ELEMENT THEREOF

[75] Inventors: Kazutoshi Hayashi, Kawasaki; Hideo Nabetani, Nagano; Toshiaki Tanaka, Kawasaki; Kazushi Ishida, Tokyo, all of Japan

[73] Assignee: Fujitsu Limited, Kawasaki, Japan

[21] Appl. No.: 919,756

[22] Filed: Oct. 16, 1986

[30] Foreign Application Priority Data

| | | | |
|---|---|---|---|
| Oct. 16, 1985 | [JP] | Japan | 60-158068[U] |
| Dec. 23, 1985 | [JP] | Japan | 60-197982[U] |
| Mar. 11, 1986 | [JP] | Japan | 61-035073[U] |
| Apr. 18, 1986 | [JP] | Japan | 61-059208[U] |

[51] Int. Cl.[4] ..... H01H 5/18

[52] U.S. Cl. ..... 200/406; 200/533; 200/345

[58] Field of Search ..... 200/340, 76, 77, 159 B, 200/67 DB, 153 L, 153 LA

[56] References Cited

U.S. PATENT DOCUMENTS

| | | | |
|---|---|---|---|
| 3,856,998 | 12/1974 | Sims, Jr. | 200/340 |
| 3,945,492 | 3/1976 | Mosby | 200/246 |
| 4,153,829 | 5/1979 | Murata | 200/340 |
| 4,249,055 | 2/1981 | Matsuo | 200/340 |
| 4,385,218 | 5/1983 | Nishida | 200/159 B |
| 4,412,113 | 10/1983 | Mitsugi et al. | 200/67 DB |
| 4,426,559 | 1/1984 | Kondo et al. | 200/67 DB |
| 4,463,233 | 7/1984 | Tanabe | 200/340 |
| 4,469,120 | 9/1984 | Anderson et al. | 200/153 LA |
| 4,484,042 | 11/1984 | Matsui | 200/67 DB |
| 4,563,555 | 1/1986 | Ohtani | 200/153 L |

FOREIGN PATENT DOCUMENTS

| | | | |
|---|---|---|---|
| 0030473 | 12/1980 | European Pat. Off. | 200/340 |
| 2813150 | 9/1979 | Fed. Rep. of Germany . | |

OTHER PUBLICATIONS

IBM Technical Disclosure Bulletin, vol. 21, No. 7, Dec. 1978, pp. 2949–2950; C. E. Norell et al.: "High Reliability Keyboard Button".

European Search Report, Berlin, 12-01-1987, Examiner Ruppert W. European Search Report, Berline, 02-03-1981, Examiner Ruppert.

*Primary Examiner*—Renee S. Luebke

*Attorney, Agent, or Firm*—Staas & Halsey

[57] ABSTRACT

A push button switch employing a dome spring switch element mounted in a vertical orientation relative to a generally horizontal orientation of a bottom support plate, and a key top and associated plunger which are mounted for limited, reciprocating vertical movement. An actuator, comprising a coil spring and a pivotally mounted lever, interconnects the plunger and the spring dome and is responsive to and converts vertical downward movement of the plunger to a horizontally directed depressing force on the dome spring for inverting the dome spring in a snap action and completing an electrical connection between inner and outer contacts mounted within the switch element and underlying the dome spring. A dome spring of rectangualr shape affords improved force versus displacement and snap action characteristics, and a contact frame providing flexible support of the inner contacts reduces impact shock and wear produced by the snap action. A locking structure provides for locked interengagement of the key top and plunger and a stepped, flexible stop absorbs shock and reduces impact noise in stopping the return movement of the plunger from a depressed to a normal condition. A direct drive connection between the plunger and the lever reduces the amount of plunger movement and depression force required to actuate the switch under abnormal load conditions. A process for fabrication of the switch element by stamping and molding steps reduces costs and improves reliability of the switch element.

20 Claims, 17 Drawing Sheets

PUSH BUTTON SWITCH USING DOME SPRING AND SWITCH ELEMENT THEREOF

BACKGROUND OF THE INVENTION

1. Field of the Invention

This invention relates to a push button switch primarily used as a keyboard switch, such as in a keyboard for a data input-output terminal unit, and, more particularly, to such a push button switch having an improved plunger stroke converting mechanism for actuating a dome spring switch element, affording an enhanced snap action, and which is of compact size and high reliability and may be produced at low cost.

2. Description of the Prior Art

There are several types of conventional push button switches, for example, switches using a mechanical contact element, switches using a non-contact switch element such as a Hall element, switches using a conductive membrane, and the like. The present invention relates to the first type switch, and employs a dome spring as a mechanical contact element.

In order to achieve good operational characteristics, e.g., both tactile and audible, of a push button switch with respect to a keyboard operator, the push button switch should function to close the switch contacts in response to the application of a key-actuating, or key-depressing, force onto the key top in the range of from 50 to 70 grams, and should provide a snap action. The snap action, more specifically, should afford a sudden decrease of the above-noted depressing force, i.e., a depressing force differential, of more than 15 grams. This depressing force differential is referred to briefly hereafter as a "snap force."

A dome spring is a suitable contactor element for closing and opening a circuit between outer and inner contacts of the switch element of such a push button switch. An example of a push button switch employing a dome spring is disclosed in U.S. Pat. No. 4,370,533, issued to S. Kamei, H. Nabetani, and R. Kinoshita on Jan. 25, 1983.

The fundamental structure of a prior art switch element employing a dome spring is shown in FIGS. 1 and 2. FIG. 1 is a synoptic, schematic and cross-sectional view of a push button switch 1 comprising a switch element 10*a* and a key assembly 10*b*. The switch element 10*a* comprises a dome spring 11 and a terminal plate 12 which is made of molded insulating material and supports therein outer and inner contacts 13 and 14, having respective lead terminals 15 and 16. The dome spring 11 has a generally circular periphery and is received within a recess 24, having a corresponding, generally circular periphery, formed in the terminal plate 12 so as to maintain a normally upwardly convex configuration, as illustrated by the cross-sectional view of FIG. 1. The key assembly 10*b* comprises a key top 17 having a plunger 18 which is received in telescoping, sliding relationship within a corresponding opening 25 provided in a top portion of a housing 50 (the latter shown only schematically, as a fragmentary segment, in FIG. 1). By downward depression of the key top 17, the plunger 18 moves downwardly through the opening 25 and its motion is transmitted to the dome spring 11 by means of a coil spring 20 and an actuator 21. The actuator 21 is pivotally mounted at its end 22 to the terminal plate 12, and includes a downward protuberance 23 corresponding to the central position of the dome spring 11. In response to the pressing action of the protuberance 23 caused by the movement of the actuator 21, the dome spring deforms, i.e., is invented, from its normal, upwardly convex shape to an upwardly concave (i.e., downwardly convex) shape, in which it closes the circuit between the outer contacts 13 and the inner contacts 14. When the depressing force on the key top 17 is removed, dome spring 11 and coil spring 20 return to their initial states due to their elastic restoring forces, raising the actuator 21 and the associated plunger 18 and key top 17 to their normal, rest positions, and opening the circuit between the outer contacts 13 and the inner contacts 14.

The dome spring characteristics are a function of various known design parameters, such as its diameter, thickness, radius of curvature, stiffness of material, etc. An example of the force-displacement characteristics of a dome spring used as a contactor in a push button switch is shown in FIG. 3. The curve shows that the displacement, plotted along the abscissa, is very small, whereas the required depressing force, plotted along the ordinate, is very large; as a result, the use of a direct drive would not afford a comfortable finger touch, i.e., tactile response, for the operation.

Therefore, the actuator 21 having a lever function and the coil spring 20 are employed (i.e., seen in FIG. 1), for reducing the level of the depressing force which must be applied to the key top 17 to produce adequate displacement thereof. The resultant key top force-displacement characteristics are shown in FIG. 4. The curve shows a snap action characteristic, occurring at "X" on the curve and corresponding to a specified relationship of the applied depressing force and resultant key top displacement; the snap action affords both audible and tactile feedback to the operator, which both make the operator feel comfortable and contribute to avoiding mistakes.

FIG. 2 is another synoptic illustration of a prior art push button switch corresponding closely to that of FIG. 1, but wherein the coil spring 20 and the actuator 21 of FIG. 1 are combined into a single actuator 21' which has elastic characteristics and is deformable. Remaining structures of the switch of FIG. 2 are the same as those in FIG. 1 and corresponding reference numerals identify the same or similar parts.

The push button switches illustrated in and explained with reference to FIGS. 1 and 2 have a problem of requiring a relatively long actuator 21 compared with other components of the switch. This arises since the force required to deform the dome spring 11 sufficiently so as to produce its snap action is of approximately a few hundred grams, the exact amount depending on the specific dome spring design; that force, however, is from two (2) to five (5) times the force of 50 to 70 grams which is considered to be preferable for the operator's finger touch. Therefore, the actuator 21 must afford a lever function and accordingly must have a total length which is several times the length of the segment thereof which extends between the pivotally mounted end 22 and the protuberance 23. Therefore, the prior art, dome spring-type of push button switches require an undesirably large housing to accommodate the long actuator, or, alternatively, the switch-element/actuator assembly and the key-top/plunger assembly must be separately mounted in the actual keyboard construction. Conversely, if the switch is to be assembled in a compact housing, it is difficult to achieve the snap action at the desired, low level depressing force.

SUMMARY OF THE INVENTION

A general object of the present invention, therefore, is to provide a push button switch, employing a dome spring as the contactor element, which is of compact size.

Another object of the present invention is to provide a push button switch having a key top depressing force which is within the desired range for comfortable actuation by an operator and which produces a snap action affording a satisfactory tactile feeling and audible response for the keyboard operator.

Still a further object of the present invention is to provide a dome spring-type push button switch having high reliability and which is suitable for mass production.

The foregoing and related objects of the present invention are achieved in accordance with the provision of a switch structure employing a terminal plate which is vertically oriented relatively to a horizontally oriented bottom plate and wherein a dome spring is received with its outer periphery engaged in an indentation of corresponding outer peripheral configuration formed in the terminal plate such that the dome spring is, correspondingly, vertically oriented. A key top and associated plunger are mounted for reciprocating movement in a corresponding vertical direction, displaced from the terminal plate and dome spring, and an actuator, including a coil spring, interconnects the plunger and the dome spring. More specifically, the actuator further comprises a pivotally mounted lever which converts the vertically directed plunger movement, produced by the application of a depressing force to the associated key top, to a horizontally directed pressing action on the dome spring. This arrangement affords a dome spring-type push button switch of compact size. Two different configurations of the actuator lever, in accordance with the present invention, are disclosed herein; one type produces an inward pressing action and the other produces an outward pressing action, relatively to the plunger and related components of the switch, for actuating the dome spring. In both types, the lever is of a generally L-shaped configuration, at least in vertical cross-section, and includes a first, generally horizontal arm portion having one end integral with a second, generally vertical arm portion. The lever is pivotally mounted at a fixed position, relative to the associated dome spring and terminal plate and the plunger, and a coil spring interconnects the free end of the horizontal arm portion and the plunger. The second arm portion carries a protuberance extending in a direction to engage the dome spring and to depress same in response to vertically downward movement of the associated key top and plunger, produced by the application of a depressing force thereto. The direction of the protuberance relative to the second arm is selected and determined in accordance with the required direction of the pressing action on the dome spring, and correspondingly the position of the pivotal mounting of the actuator lever. Further details of the arrangement of the lever configuration of the actuator are provided in the following "Detailed Description of the Preferred Embodiments" of the invention.

The switch structures of the present invention afford several improvements over the push button switches of the prior art. For example, the structures permit improved methods of fabrication including integration of the terminal and bottom plates as a single body which may be simultaneously molded, as hereafter disclosed, contributing to reduced manufacturing costs. Further, instead of the circular peripheral configuration of prior art dome springs, dome springs in accordance with the present invention may have a periphery of generally rectangular configuration, which affords a greater extent of displacement and larger snap force in conjunction with the snap action and thereby an improved and enhanced tactile response to the operator. Further, prior art dome switches, employed as contacts in prior art switch elements, are subject to being scratched due to the shock of impact when engaging the inner contacts during the inversion of the dome spring occasioned at the time of snap action. The present invention relieves the impact shock by forming the inner contacts on a flexible support, such as on a protruding portion of a metal frame element, and which thereby affords a further improvement over prior art dome type switch elements. A switch element in accordance with the design of the present invention which reduces the impact shock nevertheless may provide the increased snapping force effect when undergoing the snap action of the dome spring.

These and other details and improvements of the switch element of the present invention, including such further features as a method for increasing the reliability of the switch by a modification of the plunger and the actuating lever design, and a design for fabricating the inner and outer contacts of the switch element at lower cost, will become clear from the following detailed description of the invention, taken with reference to the attached drawings in which like elements refer to like parts, throughout.

BRIEF DESCRIPTION OF THE DRAWINGS

FIGS. 7A and 7B are elevational, cross-sectional views of a push button switch in accordance with the structure of FIG. 6, as assembled, and wherein FIG. 7A illustrates the rest, or normal condition of the associated key top and plunger, and of the dome spring and FIG. 7B illustrates the push button switch in the depressed, or actuated, condition of the key top and plunger and the inverted condition of the dome spring, produced by its snap action;

DETAILED DESCRIPTION OF THE PEFERRED EMBODIMENTS

Figure 1:
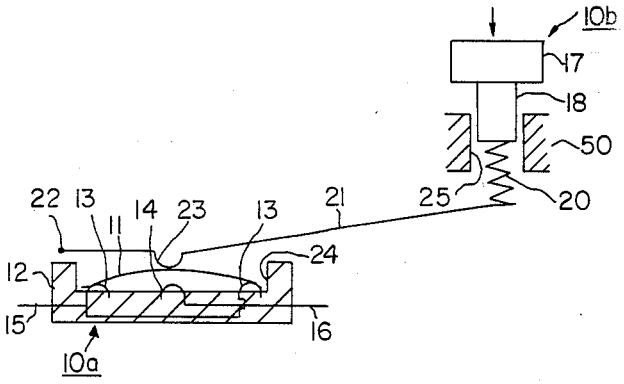
FIG.1 PRIOR ART
FIG. 1 is a schematic, synoptic and cross-sectional view of a first example of a push button switch of the prior art.
Figure 2:
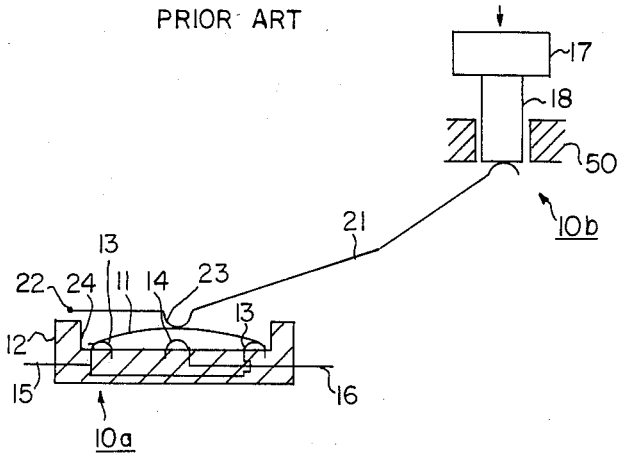
FIG.2 PRIOR ART
FIG. 2 is a schematic, synoptic and cross-sectional view of a second example of a push button switch of the prior art.
Figure 3:
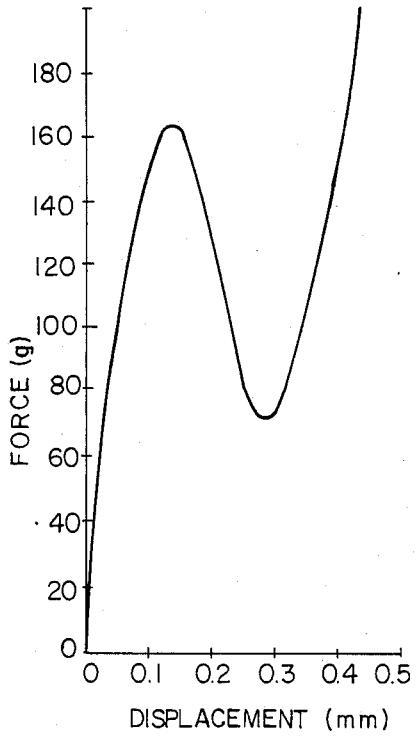
FIG. 3 is a plot illustrating the force-displacement characteristics of a conventional dome spring used as a contactor for a push button switch.
Figure 4:
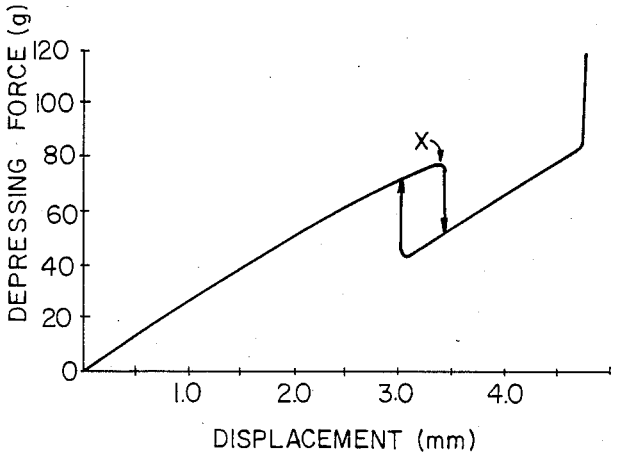
FIG. 4 is a plot illustrating the key top force-displacement characteristics of a conventional snap action, dome spring-type push button switch.
Figure 5A:
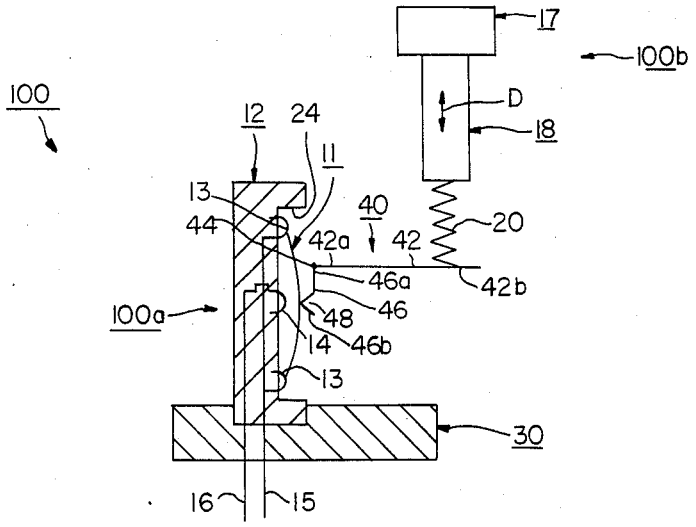
FIGS. 5A and 5B are schematic, synoptic and cross-sectional views of alternative embodiments of push button switches in accordance with the present invention.
Figure 5B:
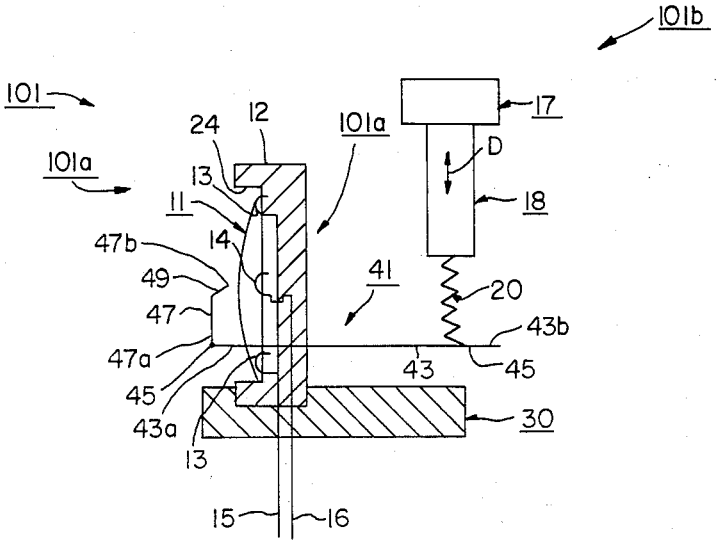

FIGS. 5A and 5B are schematic, synoptic cross-sectional views of alternative configurations of push button switches 100 and 101 in accordance with the present invention, for explaining their respective, fundamental structures, which will be seen to be quite distinct from the prior art structures of FIG. 1 and FIG. 2. In FIGS. 5A and 5B, components of the respective switch elements 100*a* and 101*a* and of the key assemblies 100*b* and 101*b* which are common to those of FIGS. 1 and 2 are identified by corresponding numerals. Thus, in FIGS. 5A and 5B, the respective switch elements 100*a* and 101*a* include corresponding terminal plates 12, each carrying outer contacts 13 and an inner contact 14 selectively engagable by a dome spring 11. The dome spring 11 is received in an indentation 24 formed in the terminal plate 12. Significantly, the terminal plates 12 and associated dome spring 11 are vertically oriented, relative to respective, horizontally oriented bottom plates 30 to which they are secured—in contrast to the prior art arrangements of FIGS. 1 and 2. The key assemblies 100*b* and 101*b* include respective key tops 17 and associated plungers 18 which are mounted by means, not shown, for vertical reciprocating movement (indicated by the double headed arrows D) in performing a plunger stroke, the direction D being vertical relatively to the horizontal bottom plates 30. In FIGS. 5A and 5B, the respective plungers 18 are connected to the respective dome springs 11 by corresponding actuators, comprising coil springs 20 and respective, pivotally mounted levers 40 and 41. The actuators convert the vertical movement of the plungers 18 in the direction D, to a horizontal movement for interacting with the respective dome springs 11.

More specifically, in FIG. 5A, the lever 40 includes a first arm 42 having a first end 42*a* and a second arm 46 having a first end 46*a* integral with the first end 42*a* of the first arm 42 and supported by the pivotal mount 44. Coil spring 20 is seated on the plunger 18 and the second, free end 42a of arm 42. A second, free end 46*a* of the second arm 46 supports a protrusion 48 adjacent the center dome spring 11. Downward depression of key top 17 and plunger 18 in the direction D functions, through coil spring 20, to rotate the lever 40 about the pivot point 44 and cause the protrusion 48 to move horizontally outwardly (i.e., to the left in FIG. 5A), and depress the dome spring 11, inverting same to an outwardly concave (or inwardly convex) configuration and thereby completing a connection between the outer and inner contacts 13 and 14.

Somewhat the reverse relationship obtains in the configuration of FIG. 5B, by the actuation of lever-actuator 41. Specifically, lever 41 comprises a first, generally horizontal arm 43 having a first end 43*a* and a second arm 47 having a first end 47*a* integrally connected to the end 43*a* and supported by the pivotal mount 45. Coil spring 20 is seated on the plunger 18 and the second, free end 43*b* of arm 43. Protrusion 49 is carried by the second, free end 47*b* of the second arm 47 and positioned adjacent the center of the dome spring 11. Depression of key top 17 and associated plunger 18 functions through coil spring 20 to depress the lever 41 and rotate same in a clockwise direction about pivotal mount 45 thereby to cause protrusion 49 to move horizontally inwardly (i.e., to the right in FIG. 5B), depressing the dome spring 11 and completing a connection between the outer and the inner contacts 13 and 14.

It will be understood that each of levers 40 and 41 in FIG. 5A and FIG. 5B, respectively, is made of a rigid material and suitably connected to the respective pivot points 44 and 45 to provide the described actuation. Further, by virtue of the location of the pivotal mount 44 intermediate the terminal 13 and plunger 18 in FIG. 5A, versus the location of the terminal plate 12 intermediate the pivotal mount 45 and the plunger 18 in FIG. 5B, the same downward vertical movement of the respective plungers 18 produce the horizontally outward movement of the protrusion 48 of the lever 40 in FIG. 5A, versus the horizontally inward movement of protrusion 49 of the lever 41 in FIG. 5B. Correspondingly, the dome spring 11 in FIG. 5A is normally convex in inward sense, whereas the dome spring 11 in FIG. 5B is convex in an outward sense. In accordance with the known characteristic of dome springs, each of the dome springs 11 in FIGS. 5A and 5B provides a snap action for closing a circuit between the respective outer contacts 13 and inner contacts 14. Further, when the depressing force on the respective key tops 17 is removed, the associated dome springs 11 and coil springs 20 resiliently return to their respective, original configurations and push the respective plungers 18 upwardly in the direction D to the initial, rest positions of each, at which the upward movement is stopped by corresponding stoppers (not shown in FIGS. 5A and 5B).

Figure 6:
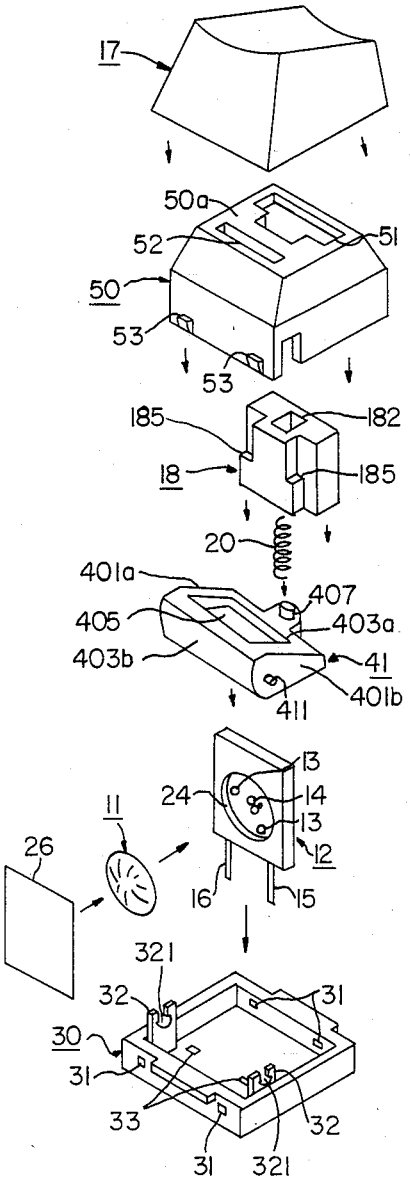
FIG. 6 is an exploded, perspective view of a practical implementation of a push button switch in accordance with the present invention, based on the schematic embodiment of FIG. 5B.

FIG. 6 is an exploded view of a practical implementation of the push button switch 101 of FIG. 5B and in which corresponding elements are identified by the same numerals as in FIG. 5B. Thus, the terminal plate 12 is adapted for being rigidly affixed to a bottom plate 30, in relatively vertical and horizontal respective orientations, the terminal plate 12 having an indentation 24 for receiving a dome spring 11 such that its convex surface extends outwardly, in the context of FIG. 5B. Outer contacts 13 and inner contacts 14 are formed in the terminal plate 13 and are connected to respective lead terminals 15 and 16 which extend through corresponding holes 33 formed in the bottom plate 30. The lever 41 comprises four arms and, more particularly, a pair of two parallel arms **401*a* and 401*b*, and a pair of two, transverse parallel arms 403*a* and 403*b*, the arms defining therebetween an opening 405 of generally rectangular cross-sectional configuration. Shafts 411 (shown only for arm 401*b*) extend in aligned relationship from the arms 401*a* and 401*b* and are received in the pivotal mounts 321 of corresponding support brackets 32 of the bottom plate 30. In the context of FIG. 5B, the parallel arms 401*a* and 401*b*, as interconnected by the transverse arm 403*a*, correspond to the first lever arm 43 of the lever 41, and the second transverse arm 403*b* corresponds to the second arm 47 of the lever 41, of FIG. 5B. The upper central portion of the first transverse arm 403*a* carried a protuberance 407 which functions as a receiving seat for the coil spring 20. A central portion of the inside surface of the second transverse arm 403*b*, moreover, has a protuberance 408 formed thereon (shown in FIG. 7A and 7B but not in FIG. 6) which functions in a manner of the protuberance 49 of FIG. 5B, to press the center portion of the dome spring 11 inwardly. Insulating film 26 is positioned over the dome spring 11 for separating and electrically insulating same from the protuberance 408**.

Figure 7A:
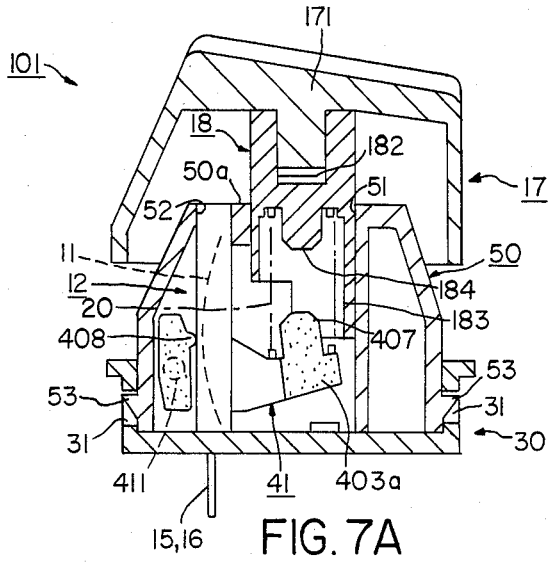
Figure 7B:
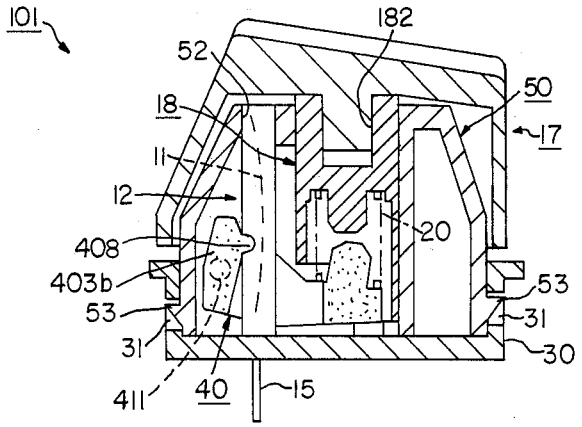

FIGS. 7A and 7B comprise vertical elevational and partially cross-sectional views of the assembled push button switch 101 of FIG. 6, and to all of which concurrent reference is now had. Particularly, the key top 17 and plunger 18 are associated with a housing 50, the latter having a slotted hole or opening 51 therein for receiving the plunger 18 and permitting vertically upward and downward sliding, or telescoping, movement thereof relative to the housing 50, and a second slotted aperture or hole 52 which receives and thereby supports an upper edge of the terminal plate 12. The terminal plate 12, moveover, extends through the opening 405 in the lever 41 and thus is located intermediate the pivotal mounts 321 of brackets 32 provided for the shafts 411 (FIG. 6) and the plunger 18. Angled tabs 53 on the lower, free edge of the parallel, vertical sidewall of the housing 50 are received in corresponding indentations or holes 31 in the peripheral vertical sidewall of the bottom plate 30, for releasably securing the housing 50 to the bottom plate 30.

FIGS. 7A and 7B respectively show the key top 17 and associated plunger 18 in a normal, upward position and a depressed, downward position. With specific reference thereto, the key top 17 includes a protrusion 171 extending generally centrally, downwardly from the lower surface thereof and which is received in an upwardly opening, corresponding aperture 182 in the top end of the plunger 18, for securing the key top 17 to the plunger 18. The lower end of the plunger 18 furthermore has a chamber 183 extending upwardly from the lower end thereof and a protuberance 184 extending downwardly from the upper end of the chamber 183 for receiving and defining a seat for the upper end of the coil spring 20. The lower end of the coil spring 20 furthermore is received and seated on the upward protuberance 407 formed on the arm **403*a* of the lever-actuator 41. Steps 185 (see FIG. 6) formed on the plunger 18 define abutments relative to the upper, horizontal surface 50*a* of the housing 50 surrounding the opening 52, which limit the upward extent of the vertical movement of the plunger 18** and thereby define its normal, rest position.

Progressing from FIG. 7A to FIG. 7B, the depressing force applied to the key top 70 and its resultant, downward movement is transmitted by the corresponding downward movement of plunger 18 and coil spring 20 to the lever 41, along with accompanying compression of the coil spring 20. Lever 41 pivots about its shafts 411, causing arm **403*b* of the lever 41 to rotate in a clockwise direction (as seen in FIG. 7B). In turn, the protuberance 408 carried by arm 403*b* moves to the right (as viewed in FIGS. 7A and 7B) and thus in an inward sense (as described with reference to FIG. 5B), for pressing against the dome spring 11 and producing accompanying compression of the coil spring 20. In the ensuing snap action, dome spring 11 inverts from its normal, outwardly convex to an outwardly concave configuration and completes the electrical connection between contacts 13 and 14, as described with reference to FIG. 5B. When the depressing force is removed, the elastic, or resilient, forces of the dome spring 11 and coil spring 20 restore the plunger 18 and correspondingly the key top 17** to the original, rest position shown in FIG. 7A.

Whereas the terminal plate 12 and bottom plate 30 are shown in FIGS. 6, 7A and 7B as separately fabricated elements which are subsequently assembled, in the alternative they instead may be fabricated in a monoblock molding process and thus as an integral, single element; moreover, lead terminals, contacts, and interconnecting leads may be simultaneously molded in place, thus greatly simplifying the assembly of the push button switch of the invention.

Figure 8:
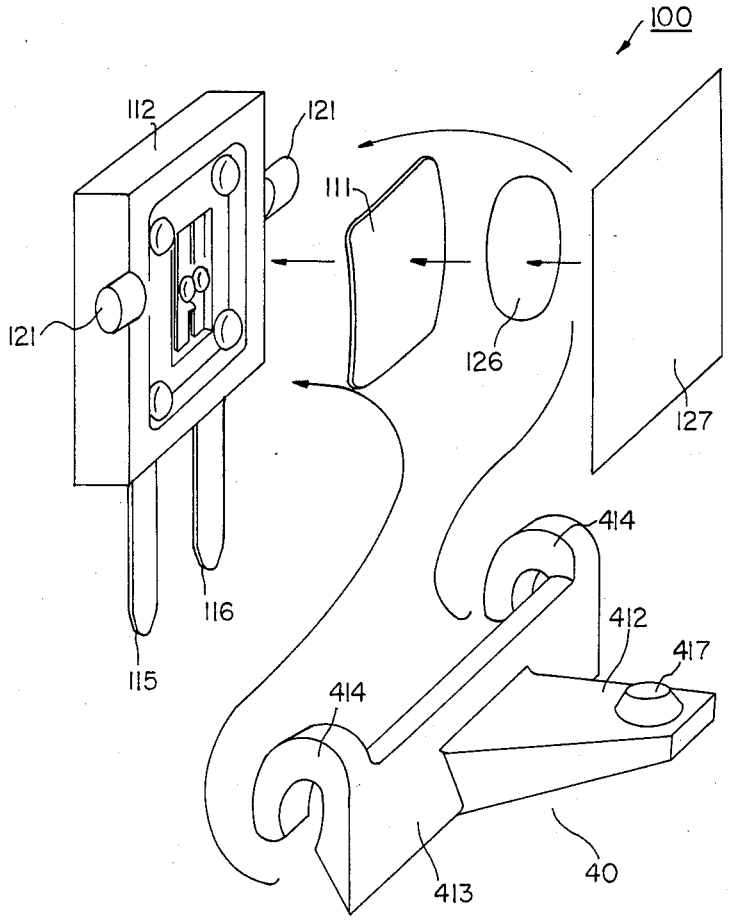
FIG. 8 is an exploded perspective view of the lever and the switch element components of a practical implementation of a push button switch in accordance with the schematic embodiment of FIG. 5A.
Figure 9:
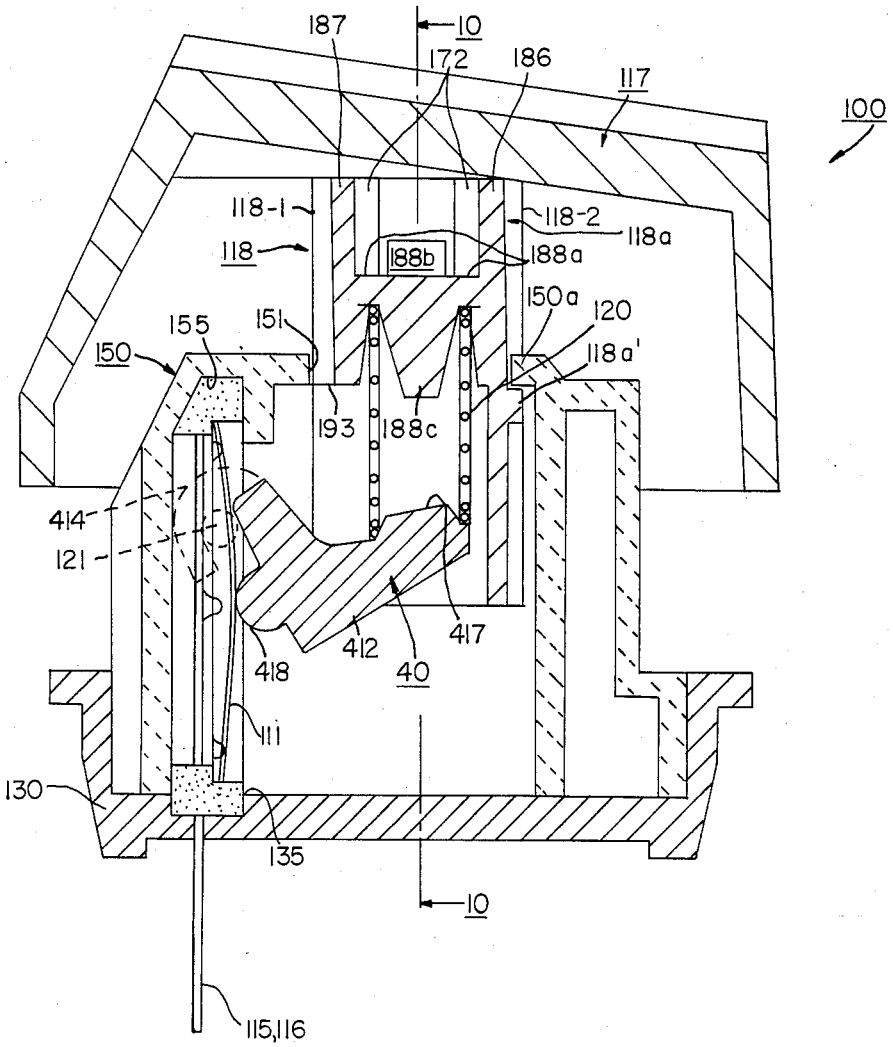
FIG. 9 is a cross-sectional, elevational view of a push button switch, as assembled, incorporating the lever and terminal plate components of FIG. 8.
Figure 10:
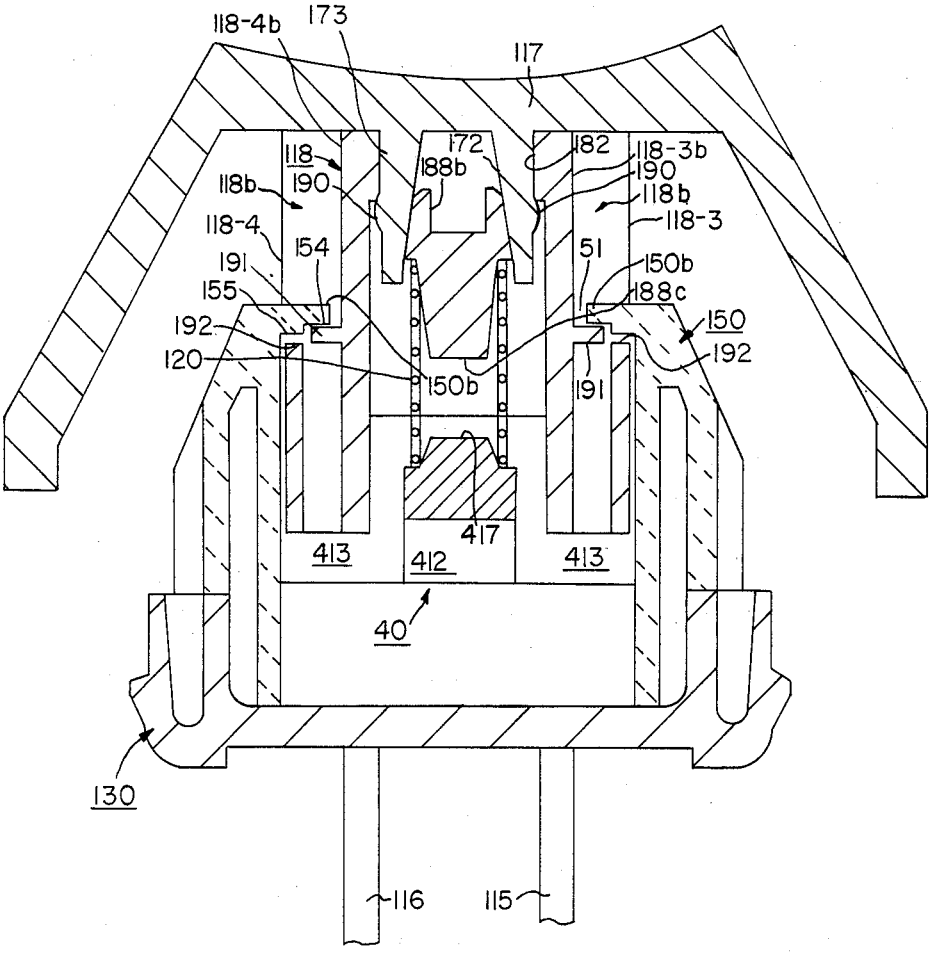
FIG. 10 is a cross-sectional, elevational view in a plane taken along the line 10—10 of FIG. 9, and thus comprising an orthogonally related, cross-sectional elevational view relative to that of FIG. 9.

FIG. 8 is an exploded, perspective view of elements of a practical implementation of a push button switch 100 of the type schematically shown in FIG. 5A, and FIGS. 9 and 10 comprise elevational and respectively orthogonal cross-sectional views of the switch 100 incorporating the assembled structures of FIG. 8, FIG. 10 being taken in a plane extending along the line 10—10 in FIG. 9. With concurrent reference to FIGS. 8, 9 and 10 and the corresponding, schematic illustration of FIG. 5B, the lever 40 comprises a lateral arm 412 and a transverse arm 413, the former connected centrally of the latter and the two extending at generally right angles to define a T-shape configuration. The lateral arm 412 and the vertical extension of the transverse arm 413 respectively correspond to the first, horizontally extending arm 42 and the second, vertically extending arm 46 of the lever 40 as depicted in FIG. 5A. Arm 412 carried a protuberance 417 on its free end, defining a seat for coil spring 20 (see FIGS. 9 and 10). The transverse arm 413 has a pair of hooks 414 formed integrally at its opposite, free ends and a protuberance 418 projecting outwardly from a central portion of the arm 413, and thus opposite to the direction of the arm 412 (see FIG. 9).

Pivotal mounting shafts 121 extend in aligned, outward transverse directions from the parallel vertical edges of the terminal plate 120 and receive the respective hooks 114 for pivotally supporting the lever 40. Dome spring 111 (FIG. 9) preferably is of a rectangular configuration, as later described, and is positioned to dispose its convex surface inwardly. An insulating film 126 and an adhesive film 127 are disposed in covering relationship with respect to the dome spring 111, as shown in FIG. 8 (not shown in FIGS. 9 and 10). The assembled relationship of the pivotal hooks 414 of the lever 40 and the shafts 121 is shown by the hidden line illustration in FIG. 9. As also seen in FIG. 9, the terminal plate 112 is secured at its lower and upper edges in corresponding slots 135 and 155 formed in corresponding regions of the base 130 and the housing 150.

Details of the structures shown in FIGS. 9 and 10 are discussed subsequently, in conjunction with further detailed drawings. For the moment, it is sufficient to note that depression of the key top 117, through plunger 118, functions to exert a downward force on coil spring 120 and to rotate the lever 40 in a clockwise direction about the pivotal mounting shafts 121, thereby to rotate the protrusion 418 in a clockwise and outward direction for, in turn, depressing the dome spring 111 outwardly, in the manner schematically illustrated in FIG. 5A, and thus in a leftward, horizontal direction as shown in FIG. 9.

Figure 11:
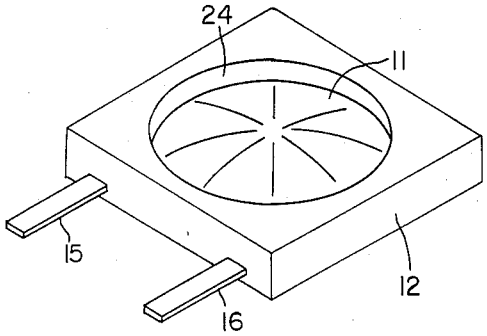
FIG. 11 is a perspective view of a terminal plate component which may be employed in the key button switches of the present invention, incorporating a conventional, circular dome spring.
Figure 12:
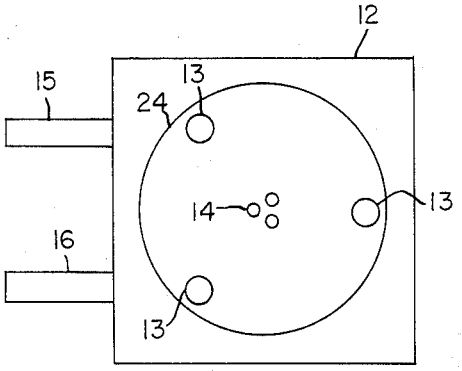
FIG. 12 is a top, plan view of the terminal plate component of FIG. 11.

As before noted, the structure of FIG. 8 utilizes a dome spring 111 of rectangular configuration, the advantages of which, relative to a conventional, circular dome spring 11 as shown in FIGS. 5A through 7B, are now explained with reference to FIGS. 11 through 15. Particularly, FIGS. 11 and 12 are perspective and top plan views, respectively, of a terminal plate 12 which accommodates a circular dome spring 11, shown in position in FIG. 11 but removed from the plate 12 in FIG. 12. With concurrent reference to FIGS. 11 and 12, three outer contacts 13 are formed in generally equiangularly spaced positions adjacent the periphery of the indentation 24 and inner contacts 14, typically comprising three protrusions, extend from the central portion of the indentation 24. The contacts 13 and 14, the lead terminals 15 and 16 and the interconnections between the respective contacts and terminals may be formed by punching from a metal sheet and then molding same in position in the fabrication of the base plate for the terminal plate 12. A dome spring 11 having a radius (r) is inserted within the indentation 24 in mechanical and electrical contact with the three outer contacts 13. The normal, outward convex configuration of dome spring 11, on the other hand, maintains the central portion thereof spaced from the inner contacts 14. Application of a depressing force to the dome spring 11 causes the latter to deform and invert the curvature thereof, from outwardly convex to outwardly concave, and thereby to make contact with the inner contacts 14 and close an electrical connection to the outer contacts 13.

In order to obtain a good tactile feeling for a keyboard operator, it is desirable that the central portion of the dome spring undergo a large displacement, at the moment of its snap action, i.e., at the moment that it moves from its outwardly convex to its outwardly concave (or, alternative, inwardly convex) configurations. This displacement amount increases as the diameter of the circular dome spring increases. Thus, to obtain a 50% increase of the linear (or radial) displacement of the dome spring at the moment of its snap action, the diameter of the dome spring must be increased by approximately 40%; this, of course, requires a corresponding and undesirable increase in the outer dimensions of the switch. The displacement also may be increased by decreasing the radius of curvature of the dome spring; this technique, however, imposes the undesirable requirement of an increased depressing force to produce the snap action, and results in shortened life of the switch.

Figure 13:
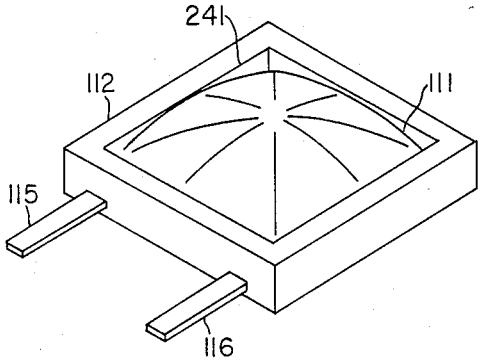
FIG. 13 is a perspective view of a terminal plate component of a key switch in accordance with the present invention, housing therewithin a rectangular dome spring in accordance with the present invention.
Figure 14:
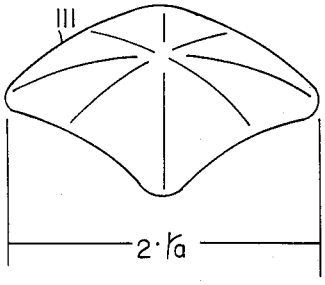
FIG. 14 is a perspective view of the rectangular dome spring of FIG. 13.
Figure 15:
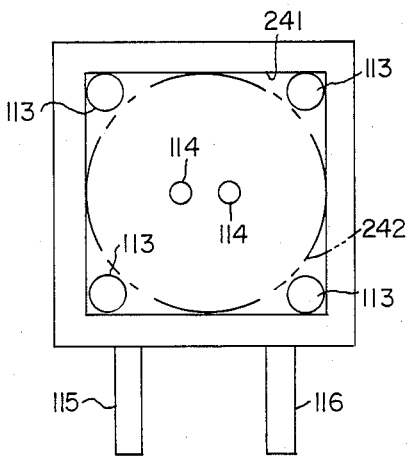
FIG. 15 is a top, plan view of the terminal plate of FIG. 13, configured to incorporate a rectangular dome spring but with the dome spring removed to reveal the underlying outer and inner contacts mounted within the terminal plate.

A dome switch of rectangular configuration affords significant benefits, compared to the characteristics of a dome switch of circular configuration, as is now discussed with reference to FIGS. 13 through 15. Particularly, FIG. 13 is a perspective view of an improved terminal plate 112 housing a rectangular dome spring 111, the latter received within a corresponding rectangular indentation 141 in the plate 112; FIG. 14 is a perspective view of the dome spring 111; and FIG. 15 is a top, planar view of the plate 112 with the spring 111 removed. FIG. 15 furthermore illustrates, by a dash-dot circular line 242, the equivalent size of a conventional circular dome spring having a radius (r), such as that of FIGS. 11 and 12. In this regard, it will be understood that the terminal plate 112 of FIGS. 13 and 15 may have the same outer dimensions as those of the terminal plate 12 of FIGS. 11 and 12. As will be further understood from FIG. 15, the four corner, or corner vertices, of the dome spring 111 seat on the respective outer contacts 113 corresponding located within the corners of the indentation 241 and, further, those contacts 113 are suitably connected together and led out to lead terminal 115. Likewise, the two inner contacts 114 are interconnected and led out to a lead terminal 116.

With reference again to FIGS. 13 through 15, and where the diagonal dimension of the generally rectangular indentation 141 (and correspondingly of the rectangular dome spring 111) is $2r_a$, the relationship between the value ($r_a$) and the radius (r) of the circle 242 in FIG. 15 is determined approximately by the following relation:

$$r_a = 1.4\ r \quad (1)$$

When the above structure of the terminal plate 112 having the rectangular dome spring 111 is utilized, the displacement at the moment of snap action is equivalent to that of a circular dome spring having a radius of $r_a$; as a result, the displacement for the rectangular dome spring 111 is approximately 1.5 times that of a circular dome spring having a radius (r), in accordance with relation (1). This significantly improves the operability of the switch and its tactile feeling. Details of the assembled structure of FIGS. 9 and 10 are not discussed with reference to the further, detailed illustrations of FIGS. 16A to 17B. Particularly, FIGS. 16A and 16B are perspective views of key top 117 and associated plunger 118, respectively, FIG. 16C being a perspective, fragmentary view of an integral, internal component 188 of the plunger 118.

The conventional key top 17 of FIG. 7 has a downwardly extending protuberance 171 which is received within a hole 182 of the plunger 18. Both the plunger 18 and the key top 17 are fabricated of plastic material and have dimensional variances in that fabrication process; this factor, coupled with possible deformation occasioned by ambient temperature variations or abrasion after long life of operation, may permit the key top 17 to slip off the plunger 18. The structure of FIGS. 9, 10 and 16A through 16C, 17A and 17B, provides an improved interconnection between the associated key top 117 and plunger 118 and overcomes this prior art problem.

Figure 16A:
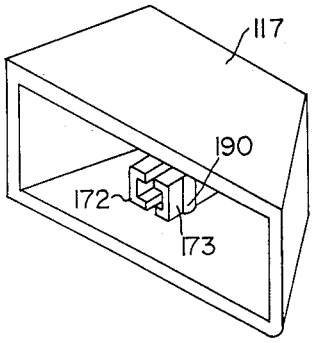
FIGS. 16A, 16B and 16C are perspective views of components of a push button switch in accordance with the present invention and as shown FIGS. 8 through 10, FIG. 16A illustrating details of a key top, FIG. 16B illustrating details of a plunger, and FIG. 16C illustrating, in a broken-away view, an internal, integral component of the plunger of FIG. 16B.
Figure 16B:
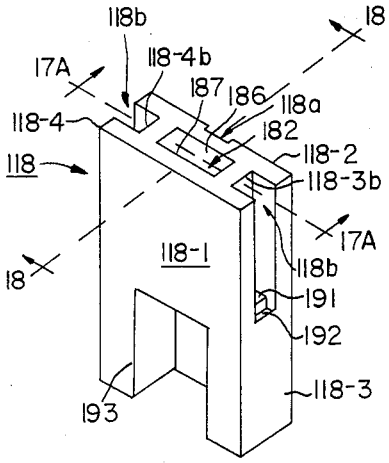
Figure 16C:
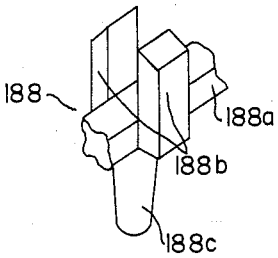

Particularly, FIG. 16A is a perspective view of the key top 117, showing its internal configuration. Vertically downwardly extending, spaced supports 172 and 173 are each of "U-shaped" cross-section (i.e., in a horizontal plane relative to the normal vertical orientation of the key top 117) and have laterally, outwardly extending horizontally oriented projections 190 (i.e., relative to the normal vertical orientation of the supports 172 and 173). FIG. 16B is a perspective view of the plunger 118, illustrating a central, downwardly extending opening, or hole, 182 therein of rectangular cross-section and defining parallel spaced, vertical interior sidewalls 186 and 187. The element 188 shown in perspective view in FIG. 16C is integrally molded within the hole 182 of the plunger 118, as will better be appreciated by the illustration of the element 188 in FIGS. 9 and 10. Particularly, the element 188 includes a first arm 182 which bridges the hole 188a and thus extends between and is integrally joined to the spaced, interior wall surfaces 186 and 187 of the hole 182. A pair of vertical, upward protrusions **188*b*, extend from the first, bridging arm 188*a* and together define a resilient wedge element. A third protrusion 188*c* extends downwardly from the first, bridging arm 188*a*** and serves as a coil spring seat, as later described.

Figure 17A:
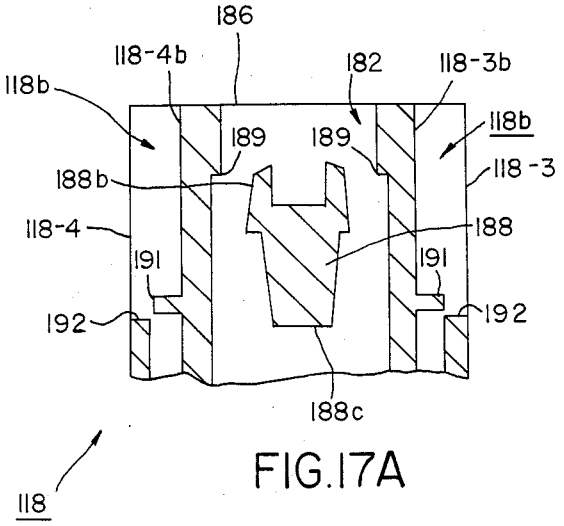
FIG. 17A is a cross-sectional view taken in a plane along the line 17A—17A in FIG. 16.
Figure 17B:
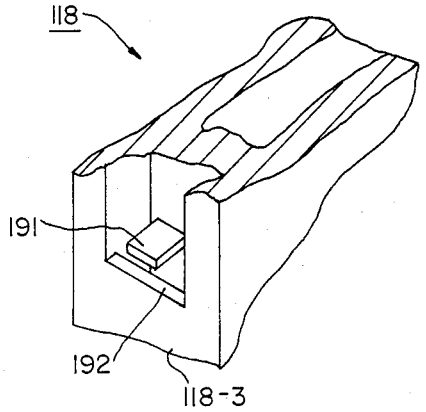
FIG. 17B is an enlarged, broken away perspective view, at a reverse angle relative to the perspective view of FIG. 16B, illustrating further details of the internal structure of the plunger.

The internal structure of plunger 118 is further clarified by reference to FIG. 17A which is a cross-sectional view of a segment of the plunger 118, as shown in FIG. 10, but prior to insertion of the vertical supports 172 and 173 of the key top 117. Steps 189 are formed on the inside surfaces of the second opposed, interior sidewalls of the plunger 118, extending inwardly at a position slightly below and spaced from the upper extremities of the corresponding, upward protrusions **188*b*. When the supports 172 and 173 of the key top 117 are inserted through the corresponding spacings as seen in FIG. 10, the projections 190 thereof are forced below the respective steps 189 and thereafter are maintained beneath same by the wedged interconnection of the supports 172 and 173 and the upward protrusions 188*b*, thereby locking key top 117 to plunger 118. The assembled and interlocked relationship of the key top 117 and plunger 118 is shown in FIGS. 9 and 10. Particularly, in FIG. 10, the protrusions 188b are received within the respective, vertically extending interior, U-shaped cross-section channels of the spaced, vertical supports 172 and 173 of the key top 117, the vertical protrusions 188b engaging the interior channels of supports 172 and 173 in mating and wedged relationship; in FIG. 9, one of the protrusions 188*b* is shown to be received within the interior channel defined by the support 172**.

FIG. 10, more specifically, illustrates the condition in which the key top 117 and associated plunger 118 have substantially, but not completely, returned to the normal, rest position, following a depression. That upward movement may be stopped by the direct abutment of rigid structures, such as the surfaces 185 which engage the lower surface of the top closure portion **50*a* of the housing 50 in FIG. 6. Accordingly, the switch assembly 100 of FIGS. 8 through 10 may incorporate a similar such direct abutment for stopping the upward movement. As seen in FIGS. 9 and 16B, for example, the plunger 118 is shown to have a pair of major parallel outer surfaces 118-1 and 118-2 and a pair of minor, parallel outer surfaces 118-3 and 118-4. A vertical channel 118*a* extends inwardly of the surface 118-2 and is of a length corresponding to the vertical travel distance of the plunger 118, surface 118*a*′ defining the lower end of channel 118*a*. A projection 150*a* of the top closure of housing 150 is received in the channel 118*a*, the lower surface of which serves as a rigid abutment stop when engaged by the surface 118*a*′ at the bottom of the channel 118*a* as the plunger 118** returns to its rest position. As will be appreciated, however, the direct impact of such rigid abutment surfaces introduces an undesirable level of noise and vibration.

The key switch 100 of FIGS. 8 through 10 incorporates a further design feature which suppresses such noise and vibration. Particularly, and with reference to FIGS. 10 and 16B, vertical channels **118*b* are formed in the opposite parallel, narrow faces 118-3 and 118-4 of the plunger 118, having respective interior wall surfaces 118-3*b* and 118-4*b*, each of which carries a corresponding lateral projection 191 of a thickness rendering it somewhat flexible. As best seen in FIG. 10, corresponding projections 150*b* of the top closure of housing 150 are received in the channels 118*b*. Each of the projections 150*b* of the housing 150 is undercut so as to define stepped portions 155 and 154, the portion 154, since of reduced thickness, having an increased relative degree of flexibility. Accordingly, during upward movement of the plunger 118, the flexible projections 191 first engage the respective, flexible, stepped portions 154, producing a resilient or yielding limitation to the upward movement of the plunger 118 and reducing, or absorbing, the mechanical shock and accompanying noise otherwise produced by a rigid abutment stop. Subsequently, the rigid top portions 192 of the sidewalls 118-3 and 118-4 engage the relatively rigid stepped portions 155 of the projections 150*b* and thereby completely stop any further upward movement of the plunger 118 and key top 117. The rigid stops afforded by surfaces 192 and 155 thus supplement the rigid stop provided by the surface 118***a*′ and projection 150*a* described with reference to FIG. 9.

Figure 18:
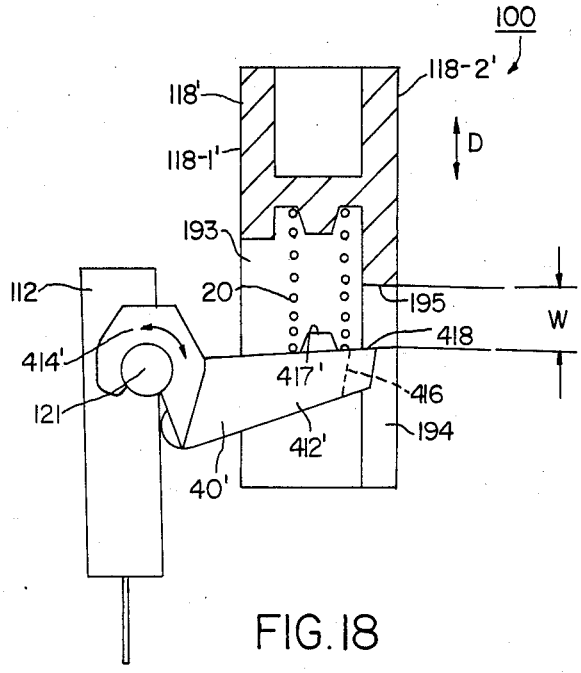
FIG. 18 is a synoptic, side elevational view of the plunger, partially in cross-section and taken in a plane along the line 18—18 in FIG. 16B, and of related elements as shown in FIG. 8.

FIG. 18 illustrates a plunger 118′ and lever 40′ which generally correspond to the previously disclosed plunger 118 and lever 40, but which are modified to provide a supplemental, direct drive engagement therebetween in the case of abnormal depressing force conditions. More particularly, FIG. 18 is an elevational, partially cross-sectional view similar to that presented for the corresponding elements in FIG. 9 and may be viewed as taken in the plane along the line 18—18 in FIG. 16B, but incorporating the modifications now addressed. Elements otherwise identical to those of FIGS. 9 and 16B are identified by identical numerals.

As shown in FIG. 18, in addition to the opening 193 provided in the major wall 118-1′ of plunger 118′ for accommodating the lever 40′, the opposite major wall 118-2′ of the plunger 118′ has a second opening 195 for accommodating an extended, or elongated, lever arm 412′. By comparison, the lever arm 412 of FIG. 9 is of a length sufficient to carry the protuberance 417 defining a seat for the coil spring 120, but does not extend beyond the interior chamber. This would correspond to the lever arm 412′ having a length defined by phantom line 416 in FIG. 18. However, the plunger 118′ of FIG. 18 includes a further opening 194 in the sidewall 182-2′ extending to the interior, lower chamber, and the lever arm 412′ is extended such that its upper surface 418 adjacent its free end is aligned with the lower surface 195 of the sidewall 118-2′ defining the upper limit of opening 194, and thus lies in its path of downward travel when the plunger 118′ is depressed. Accordingly, where an abnormal condition exists which restrains rotation of lever 40′, to the extent that the force required to depress plunger 118′ exceeds the opposing force of coil spring 20, the lower surface 195 of the plunger 118′ may directly engage the surface 418 of lever 40′ and cause the latter to rotate. As will be made clear, the height of opening 194 is related to the position of arm 412′ of lever 40′ relative to plunger 118′ when coil spring 20 is compressed during depression of key top key 117′ and the associated plunger 118, under normal load conditions. An abnormal condition, requiring application of such an abnormal force, may occur due to a poor fit of the lever hook 414′ on the pivotal mounting shafts 121, due to variations in the elastic deformation characteristics of the dome spring (not shown in FIG. 18) carried by the terminal plate 112, or the like.

Figure 19:
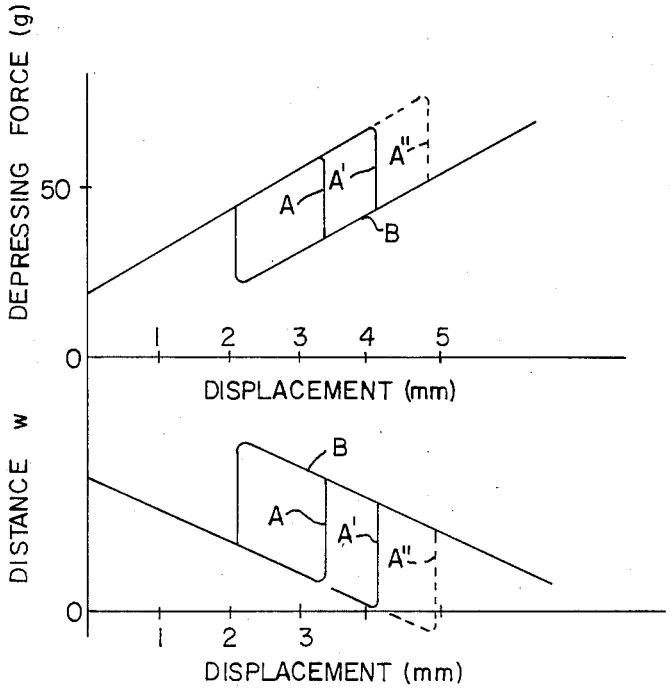
FIG. 19 comprises a graph having dual plots of the displacement distance (w) illustrated in FIG. 18 and of the corresponding depressing force (g), both as a function of the displacement distance of the associated key top and plunger of the structure of FIG. 18, the characteristic curves illustrating conditions of abnormal depressing force requirements and the accommodation and compensation provided therefor by the structure of FIG. 18.

The direct engagement in fact affords the beneficial result of reducing the increased depressing force necessary for producing actuation under such an abnormal condition, as now discussed in relation to FIG. 19. FIG. 19 is a combined plot of the distance (w), as shown in FIG. 18, and the depressing force (g) applied to the plunger 118′, both plotted along the ordinate, and the corresponding actual displacement of the plunger 118′, plotted along the abscissa. In both plots of FIG. 18, the curves A and B show the normal operation of the switch 100. When an abnormal condition requiring an abnormally large depressing force occurs, and in the absence of the extended lever arm 412′ having the engagement surface 418, the required displacement of the plunger 118′ would result in extending each of the curves A to the positions of curve A″. (It will be understood in this context that coil spring 20 would compress by an amount greater than (w) and correspondingly that the distance (w) in the graph of FIG. 19 may assume negative values.) However, through the provision of the elongated lever arm 412′, as the distance (w) reduces to zero and thus as the engaging surfaces 195 and 418 in FIG. 18 come into contact and the depressing force on plunger 118 is applied directly to surface 418 of the lever 40′, the relationships shown by curves A′ in each of the plots of FIG. 19 result. The upper plot of FIG. 19, by comparison of the specific curves A′ and A″, thus shows that with the structure of FIG. 18, a reduced depressing force (g) will suffice to produce the required rotation of lever 40′ under abnormal load conditions.

The present invention moreover provides an improved construction of the dome spring type switch element affording improved operating characteristics and longer life and which, moreover, may be fabricated readily and at lower cost. By way of comparison and for review, FIGS. 11 and 12, described herebefore, illustrate a conventional dome spring switch element; typically, the lead terminals 15 and 16 and the contacts 13 and 14 are fabricated by stamping from a metal sheet and then are molded into the plastic material of the terminal plate 12. Since the outer and inner contacts 13 and 14 thus are molded firmly in the plastic body of the terminal plate 12, with each snap action and thus inverting of the dome spring 11, the undersurface of the dome spring 11 and the inner contacts 14 undergo a non-yielding, mechanical impact. This produces scratching of the respective surfaces and, ultimately, contributes to malfunctioning of the electrical contact characteristics and a decrease in the displacement of the dome spring 11 and thus a reduced snap action.

Figure 20A:
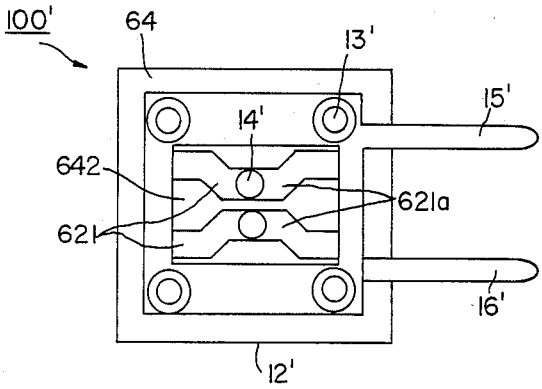
FIGS. 20A and 20B are top plan and side elevational views, respectively, of an improved switch element and contact assembly incorporating a rectangular dome spring in accordance with the present invention.
Figure 20B:
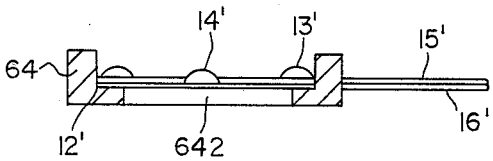
Figure 21:
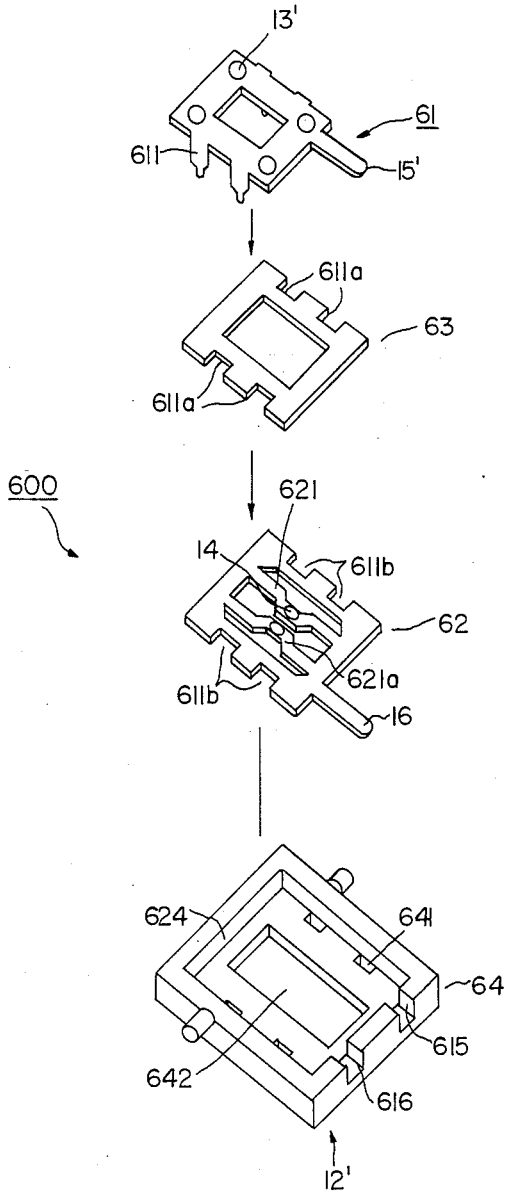
FIG. 21 is an exploded, perspective view of the switch element of FIGS. 20A and 20B.

An improved form of a switching element 600 is shown in the plan and side elevational, cross-sectional views of FIGS. 20A and 20B and in the exploded, perspective view of FIG. 21. Elements corresponding generally to the conventional structure of FIGS. 11 and 12 are shown by identical, but primed numerals. With concurrent reference thereto, an inner electrode frame 62, an insulating film 63, and an outer electrode frame 64 are inserted, in succession, into the indentation 624 in the molded plastic base 64 of the terminal plate 12′. Four downwardly depending claws 611, two on each of the parallel side edges of the electrode frame 61, are received through corresponding slots 611*a* in the insulating film 63 and slots 611*b* in the inner electrode frame 62 and through slots 641 formed in the base 64, for securing the assembly together. The base 64, moreover, includes slots 615 and 616 through which the respective lead terminals 15′ and 16′ are received and project outwardly from the base 64. Outer contacts 13′ are formed on the oter electrode 61 and inner contacts 16′ are formed on the interior frame elements 621 of the inner electrode frame 62. The interior frame elements 621 further have centrally protruding portions 621*a* on which the contacts 14′ are formed and thus have a generally meandering shape, enhancing the flexibility of the support provided thereby for the contacts 14′. A generally rectangular hole 42 is formed in a central portion of the molded base 64, underlying the interior frame elements 621, permitting the latter to flex when the inner contacts 14′ are engaged and pressed downwardly by the snap action of the associated dome spring (not shown in FIG. 21, but which preferably is of the rectangular shape hereinbefore described).

Figure 22:
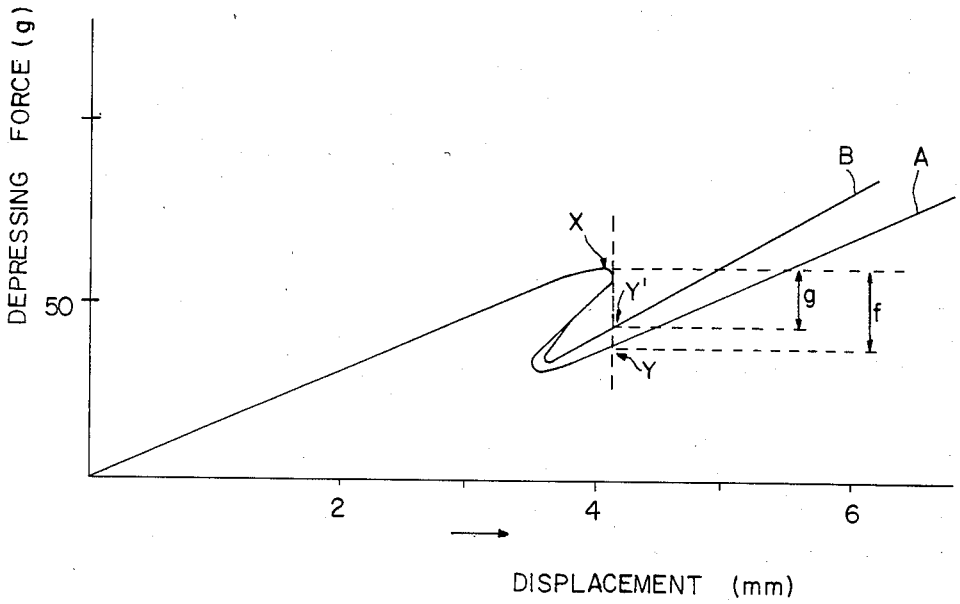
FIG. 22 is a plot of the depressing force (g) as a function of the amount of displacement of a key top and associated plunger, the curve A thereof illustrating the increased snap force produced by actuation of the key top and plunger of the improved switch element structure of FIGS. 20A, 20B and 21.

The improved operating characteristics afforded by the switch structure of FIG. 21 having flexible inner contacts, by comparison to a conventional switch element having fixed inner contacts, is demonstrated by plot of FIG. 22. More particularly, curve A represents the characteristics of the improved switch element of the invention as illustrated in FIG. 21 whereas curve B represents the characteristics of a conventional switch element having fixed inner contacts. Further, the displacement of the respective key tops is plotted along the abscissa and the corresponding depressing forces (g) are plotted along the ordinate. Curves A and B coincide throughout the displacement, from zero up to a point X of approximately 4 millimeters displacement, representing the snap action of each of the switches. At point X, the depressing force (g) reduces to the values defined by points Y and Y' for the curves A and B, respectively, the corresponding force differentials being shown by the dimensions (f) for curve A and (g) for curve B. As before noted, it is desirable to provide a large snap force; thus, the improved key switch structure of FIG. 21 affords an improvement over the conventional key switch element by virtue of the larger snap force afforded thereby, as illustrated in FIG. 22 by the greater force differential (f) of curve A. Curve A thus demonstrates that the flexible mounting of the inner contacts in the structure of FIG. 21 contributes not only to an increased snap force with the result of affording a better tactile feeling to an operator, but also serves to absorb the impact shock of the snap action and thereby reduce wear damage to the contacts and dome spring.

Figure 23:
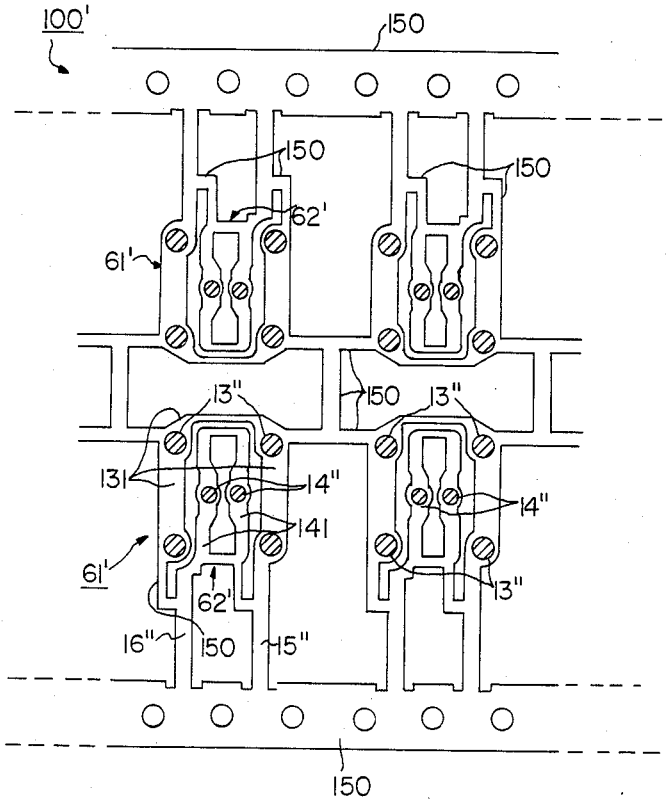
FIG. 23 is a plan view of a stamped metal sheet pattern defining inner and outer electrodes and interconnecting wiring and structural support portions produced by a simplified fabrication process of the present invention for forming the improved switching element structure of FIGS. 20A, 20B and 21.
Figure 24:
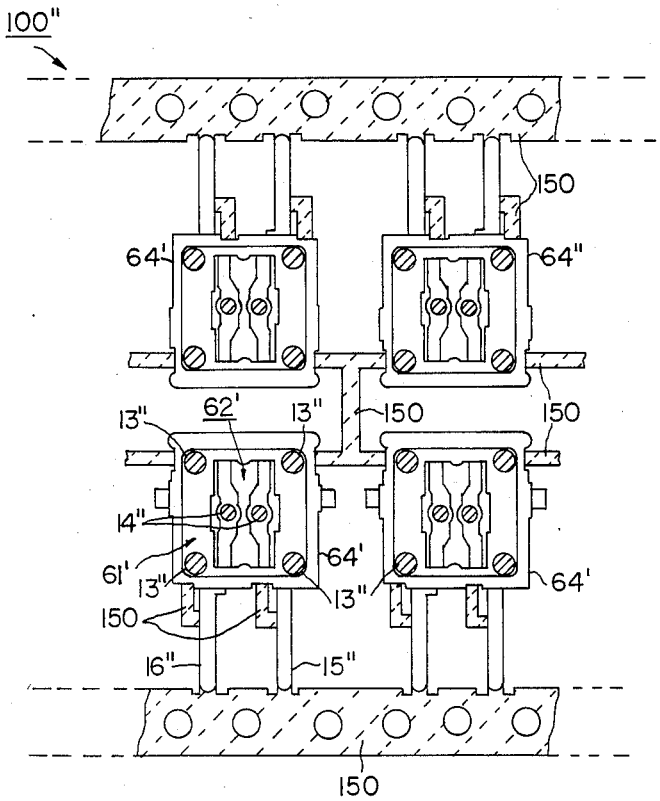
FIG. 24 is a top plan, schematic view illustrating the results of a molding process for forming a plastic base as a terminal plate incorporating the contacts and metal interconnecting pattern of FIG. 23 and further schematically indicating portions of the stamped metal pattern which are removed in defining individual switching elements, in accordance with the present invention.

Whereas the switching element 600 of FIGS. 20 and 21 presumes separate fabrication and subsequent assembly of the inner and outer contact frames 62 and 61 and related structures, switches having substantially the identical, effective structure and identical operating characteristics may instead by fabricated by the simplified process described in conjunction with FIGS. 23 and 24. In FIG. 23, outer contacts 13", inner contacts 14", lead terminals 15" and 16", and interconnecting portions 131 and 141 are formed from a continuous metal sheet by a punching process. A preferred process is to punch a related, opposed pair of two complete such patterns in each punching operation. Each punched pattern includes the necessary elements for each of the frames 61 and 62 of FIG. 21 and which are correspondingly identified at 61' and 62', respectively, in FIG. 23. Thus, the interconnecting wiring portions 131 correspond to the rectangular portions of the frame element 61 in FIG. 21 and provide for mechanical and electrical connection to the segment 15" in FIG. 23 corresponding to the external lead terminal 15' in FIG. 21. The interconnecting portions 141 correspond, similarly, to the internal frame elements 621 of the frame 62 and furthermore are interconnected electrically and structurally at their opposite ends and to the element 16" (FIG. 23) corresponding to the external lead terminal 16' of the frame 62 in FIG. 21. Additionally, metal segments 150 remain, which structurally interconnect the plurality of patterns, i.e., each pattern containing a combination of the electrical frames 61' and 62', to facilitate handling and further processing.

After the interconnected patterns are stamped in the continuous metal sheet, they are subjected to a molding process, producing the results shown in FIG. 24. Specifically, each pattern of a combination of frame 61' and 62' is encased in its individual molded base 64', corresponding in structure and function to the individual, pre-molded frame 64 of FIG. 21. Thereafter, the mechanical interconnecting portions 150 of the metal strip are removed. With concurrent reference to FIGS. 23 and 24, it thus will be appreciated that the interconnecting portions 131 electrically interconnect the outer contacts 13" of the frame 61' to the corresponding lead terminal 15", and the interconnecting portions 141 of the frame 62' provide both the flexible mechanical support for the inner contacts 14' and their electrical connection to the corresponding external lead terminal 16". The fabrication structure and process illustrated in FIGS. 23 and 24 thus affords both simplification and reduced costs of fabrication and increased reliability of the switching element.

Numerous modifications and adaptations of the features of the key switches of the present invention will be apparent to those of skill in the art and thus it is intended by the appended claims to cover all such modifications and adaptations which fall within the true spirit and scope of the invention.

We claim:

1. A push button switch comprising:

a bottom plate;

a plunger and an associated key top;

means for mounting said plunger and associated key top for limited, reciprocating movement along a generally vertical axis relative to a generally horizontal orientation of said bottom plate;

a terminal plate affixed to said bottom plate in a vertical orientation relative to said horizontal orientation of said bottom plate, the terminal plate having a first major surface generally parallel to the vertical axis, an indented surface with a periphery of a predetermined configuration displaced inwardly of and parallel to the major surface in a first horizontal direction relatively to the vertical axis and a central recess within the indented surface, further displaced from the indented surface in the first horizontal direction;

plural outer contacts fixedly mounted at predetermined positions on said terminal plate within and adjacent the periphery of the indented surface and disposed to protrude toward said first major surface; plural inner contacts and means for flexibily mounting said plural inner contacts within the recess in the indented surface of the terminal plate, centrally of the periphery of the indented surface and protruding toward the first major surface, the mounting means resiliently urging the plural inner contacts toward the first major surface and thus in a second horizontal direction, opposite to the first horizontal direction, and permitting limited, resiliently yielding movement of the plural inner contacts in the first horizontal direction;

a dome spring disposed in a generally vertical orientation and having a convex configuration oriented in the second horizontal direction, said dome spring having a substantially continuous surface normally in the aforesaid convex configuration in the second horizontal direction and being susceptible to a depressing force applied thereto in the first, opposite horizontal direction to snap to a convex configuration oriented in the first horizontal direction and upon release of the force to resiliently return to the second horizontal direction, the periphery of the dome spring being normally in contact with the plural outer contacts in each of the first and second horizontal directions of its convex configuration; and an actuator interconnecting said plunger and said dome spring and responsive to downward vertical movement of said plunger to apply a depressing force in the first horizontal direction for depressing and causing said dome spring to snap to the first horizontal direction, thereby to complete an electrical connection through said dome spring between said first and second contacts, the actuator comprising a lever having first and second arms extending at right angles from one another in a plane transverse to the main surface of the terminal plate and parallel to the generally vertical axis, the free end of the first arm defining a spring seat aligned with the generally vertical axis, means associated with the second arm of the lever for engaging and applying said depressing force to said dome spring and means for mounting the lever for limited pivotal movement about a pivot axis transverse to the first and second arms and adjacent and parallel to the plane of the indented surface of the terminal plate, the actuator further comprising a coil spring received on the spring seat of the first arm and connected to the plunger.

2. A push button switch as recited in claim 1, wherein said coil spring is mounted in axial alignment with said vertical direction of movement of said plunger.

3. A push button switch as recited in claim 1, wherein said engaging and applying means associated with said second arm of said lever comprises a protuberance projecting from said second arm in said first horizontal direction.

4. A push button switch as recited in claim 1, wherein:

said first horizontal direction of said convex dome spring is inward, toward the vertical axis of movement of said plunger;

said pivotal mounting means defines said pivot axis of said lever at a position intermediate said vertically oriented dome spring and said vertical axis of movement of said plunger; and said lever is responsive to downward movement of said plunger to pivot about said pivot axis and cause said means associated with said second arm to apply the depressing force to said dome spring in an outward, second horizontal direction.

5. A push button switch as recited in claim 4, wherein said engaging and applying means associated with said second arm of said lever comprises a protuberance projecting from said second arm of said lever in said outward, second horizontal direction.

6. A push button switch as recited in claim 5, wherein:

said second arm of said lever extends transversely of said horizontal direction and said first arm of said lever extends in said horizontal direction from a central portion of said second arm, in a T-shaped configuration;

said second arm has a transverse dimension greater than the width of said terminal plate; and said pivotal mounting means comprises shafts mounted on opposite vertical edges of said terminal plate in aligned relationship with said pivot axis, and pivotal support elements formed on respective, opposite ends of said transverse dimension of said second arm adjacent the second end thereof and received on respective, said shafts.

7. A push button switch as recited in claim 6, wherein said protuberance of said second arm is disposed at a central position of said transverse dimension thereof and adjacent said first end thereof.

8. A push button switch as recited in claim 1, wherein:

said first horizontal direction of said convex dome spring is outward, and away from the vertical axis of movement of said plunger;

said vertically oriented dome spring is positioned intermediate said axis of pivotal movement of said lever defined by said pivotal mounting means and said vertical axis of movement of said plunger; and said lever is responsive to downward movement of said plunger to pivot about said pivot axis and cause said means associated with said second arm to apply the depressing force to said dome spring in an inward, second horizontal direction.

9. A push button switch as recited in claim 8, wherein said engaging and applying means associated with said second arm of said lever comprises a protuberance projecting from said second arm of said lever in said inward, second horizontal direction.

10. A push button switch as recited in claim 8, wherein:

said first arm of said lever has a generally rectangular opening therein defining corresponding, spaced first arm portions parallel to each other and to said first and second horizontal directions and a transverse arm portion extending between and interconnecting the free ends of said first arm portions; and said second lever arm extends transversely along the edge of the rectangular opening, parallel to the said transverse arm portion of said first arm; and said terminal plate is received through said rectangular opening in said lever.

11. A push button switch as recited in claim 1, wherein said indentation is of generally rectangular configuration;

said plural outer contacts are secured in respective corners of said rectangular indentation; and said dome spring has a rectangular outer peripheral configuration corresponding to the rectangular periphery of said rectangular indentation.

12. A push button switch as recited in claim 1, further comprising:

means for resiliently limiting upward vertical movement of said plunger as said associated plunger and key top return from a depressed position to a normal, rest position.

13. A push button switch as recited in claim 1, further comprising means for positively interlocking said key top with said plunger.

14. A push button switch as recited in claim 13, wherein said means for positively interlocking said key top and said plunger comprise:

a vertical opening extending downwardly within said plunger from the upper end thereof and defining corresponding interior sidewalls of said plunger, at least two said interior sidewalls being in spaced and opposing relationship and having protrusions thereon extending inwardly of said opening;

an upwardly extending wedge element centrally disposed between said inwardly extending protrusions and secured to said interior sidewalls of said plunger and defining corresponding channels between the respectively corresponding, opposed surfaces of said wedge element and said protrusion;

at least first and second elongated support elements extending in spaced relationship, vertically downwardly from said key top and inserted through said vertical opening in said plunger and individually through respective said channels and receiving said wedge element therebetween; and each of said support elements including an outward protrusion received beneath the respective inwardly extending protrusions of said interior sidewalls, when said support elements are fully inserted within said plunger, positively interlocking said key top with said plunger.

15. A push button switch as recited in claim 1, wherein said plunger further comprises:

an interior chamber extending upwardly from the lower end of said plunger and a spring seat at the upper end of said chamber for receiving and seating at least the upper end of said coil spring, said coil spring being subject to compression during downward vertical movement of said associated key top and plunger to impart a force of a predetermined amount for pivoting said lever; and means providing direct engagement of said plunger and said lever when the force applied to depress said associated key top and plunger to achieve rotation of said lever exceeds said predetermined force amount.

16. A push button switch as recited in claim 1, further comprising:

a housing having sidewalls securable at the lower ends thereof to said bottom plate and a top closure joining the upper ends of said sidewalls, disposed in surrounding relationship with respect to said switch element and said actuator, said top closure defining an opening through which said plunger extends;

at least one vertical channel in a vertical sidewall of said plunger, of a length corresponding to the path of travel of said plunger between the depressed and normal, rest positions of said associated key top and plunger;

a resilient projection extending outwardly from said plunger and within said channel, at the lower end of said channel;

a rigid stop surface defined by said sidewall of said plunger, adjacent said channel and displaced vertically below said flexible projection; and said housing further defines at least one stepped protrusion extending inwardly of said opening therein through which said plunger extends, each said stepped protrusion being received in a corresponding said vertical channel of said plunger and including a first, flexible portion for engaging said resilient projection of said plunger as said plunger returns from a depressed to a normal, rest position and reducing impact shock and noise and a second, rigid portion engaging said rigid stop surface of said plunger for stopping upward vertical movement of said plunger at said rest position.

17. A push button switch as recited in claim 1, wherein said plunger further comprises:

an interior chamber extending upwardly from the bottom end of said plunger;

a spring seat at the upper end of said interior chamber for receiving and seating the upper end of said coil spring;

an opening through a first vertical sidewall of said plunger to said interior chamber for receiving at least the free end of said first arm of said lever, said opening being of sufficient vertical height to permit depression of said plunger and compression of said coil spring in response to a depressing force supplied to said associated key top and plunger for rotating said lever.

18. A push button switch as recited in claim 17, wherein said plunger further comprises:

an opening to said interior chamber through a second vertical sidewall of said plunger, opposite said first vertical sidewall, of a predetermined vertical height, and said second vertical sidewall defining an engagement surface at the top of said opening therein;

said free end of said first arm of said lever extending into said opening in, and defining an engagement surface vertically aligned with, said second sidewall engagement surface; and said coil spring being subject to compression during the application of a predetermined depressing force to said associated key top and lever for transmitting said predetermined depressing force to said first arm of said lever for rotating said lever, and said predetermined vertical height of said opening in said second sidewall being selected such that when said depressing force applied to said associated key top and plunger exceeds said predetermined depressing force for rotating said lever, said second sidewall engagement surface engages said engagement surface of said free end of said first arm of said lever for directly applying the depressing force from said plunger to said first arm of said lever for rotating said lever.

19. A push button switch as recited in claim 1, wherein:

said indentation has a generally rectangular periphery;

said plural outer contacts are fixedly mounted in corresponding corners of said rectangular indentation;

said dome spring has a rectangular periphery corresponding to said periphery of said indentation of said terminal plate and there are further provided;

lead terminals extending from said terminal plate respectively corresponding to said plural outer contacts and said plural inner contacts; and means for interconnecting said plural inner and outer contacts with the respectively corresponding said lead terminals.

20. A push button switch as recited in claim 1, wherein:

said indentation has a generally rectangular periphery;

a first metal frame is received in said terminal plate and has a generally rectangular configuration corresponding to the periphery of said generally rectangular indentation, said first metal frame defining said outer contacts disposed adjacent corresponding corners of said rectangular indentation and protruding toward said first major surface and further comprising a first lead terminal extending outwardly from said terminal plate and electrically interconnected with said outer contacts;

said flexible mounting means comprises a second metal frame disposed interiorly of said first metal frame and within said indentation of said terminal plate and defining said inner contacts thereon, said second metal frame defining a second lead terminal extending exteriorly of said terminal plate and electrically interconnected with said inner contacts; said second metal frame spanning said recess and being of a flexible material to permit limited flexible movement of said plural inner contacts in a direction transverse to and away from said first major surface of said terminal plate; and said dome spring has a generally rectangular outer periphery corresponding to said rectangular indentation of said terminal plate.

* * * * *

UNITED STATES PATENT AND TRADEMARK OFFICE

CERTIFICATE OF CORRECTION

PATENT NO. : 4,803,316

DATED : February 7, 1989

INVENTOR(S) : Hayashi et al.

It is certified that error appears in the above-identified patent and that said Letters Patent is hereby corrected as shown below:

Front Page, Col. 2, line 4, start a NEW LINE beginning with "European";

Col. 10, line 59, "corner," (first occurrence) should be --corners,--;

Col. 11, line 17, "structure" should be --structures--;

Col. 12, line 16, "recived" should be --received--;

Col. 13, line 44, "top key 117'" should be --top 117'--.

Signed and Sealed this

Twenty-fifth Day of July, 1989

*Attest:*

*Attesting Officer*

DONALD J. QUIGG

*Commissioner of Patents and Trademarks*